United States Patent [19]

Harman et al.

[11] 4,419,659

[45] Dec. 6, 1983

[54] INTRUSION DETECTION SYSTEM USING LEAKY TRANSMISSION LINES

[75] Inventors: Robert K. Harman, Kanata; Ronald W. Clifton, Nepean; Russell E. Patterson, Ottawa, all of Canada

[73] Assignee: Control Data Canada, Ltd., Ottawa, Canada

[21] Appl. No.: 283,314

[22] Filed: Jul. 14, 1981

[30] Foreign Application Priority Data

Apr. 16, 1981 [CA] Canada ..... 375684

[51] Int. Cl.[3] ..... G08B 13/24

[52] U.S. Cl. ..... 340/552; 343/5 PD

[58] Field of Search ..... 340/552, 554, 553; 343/5 PD

[56] References Cited

U.S. PATENT DOCUMENTS

| | | | |
|---|---|---|---|
| 3,794,992 | 2/1974 | Gehman | 343/258 B |
| 3,947,834 | 3/1976 | Gershberg et al. | 340/554 |
| 4,091,367 | 5/1978 | Harman | 340/258 A |
| 4,107,659 | 8/1978 | Massa | 340/552 |
| 4,114,146 | 9/1978 | Inoue et al. | 343/5 PD |
| 4,207,560 | 6/1980 | Poirier | 340/552 |

*Primary Examiner*—Glen R. Swann, III

*Attorney, Agent, or Firm*—Jones, Tullar & Cooper

[57] ABSTRACT

A sensitive intrusion detection system has an RF excited antenna located within the area to be protected and a leaky coaxial cable extending around the perimeter. The presence of an intruder alters the coupling between the antenna and the coaxial cable thereby changing the signal received by the cable. The detection system is responsive to incremental changes in the in-phase and quadrature components of the received signal. When these components are plotted against each other a cardioid-like curve is obtained in the ΔI,ΔQ plane. By tracking both magnitude and angle of this curve as it is generated a sensitive detection mechanism is provided. When the variations in magnitude and angle exceed a threshold an alarm is sounded. To avoid the possibility of intruders using a particular path would gives a null angle response, a second cable adjacent to the first may also be employed. A further embodiment illustrates the use of three cables together with a separate antenna which provides multiple independent sensing systems.

17 Claims, 15 Drawing Figures

INTRUSION DETECTION SYSTEM USING LEAKY TRANSMISSION LINES

BACKGROUND OF THE INVENTION

This application relates to intrusion detection systems, and, in particular, to systems with a centrally located antenna and a transmission line extending around the perimeter to be protected. The system encompasses signal processing circuits which calculate and accumulate incremental changes related to phase and magnitude of the received energy and use the accumulated values as indications of the presence of an intruder.

The use of leaky coaxial cables in intrusion detection systems is known. As described in Canadian Pat. No 1,014,245 and the corresponding U.S. Pat. No. 4,091,367 a pair of leaky coaxial cables can be used to identify an intruder crossing the cables. One of the cables is connected to a transmitter and the other to a receiver. Another system, as disclosed in U.S. Pat. No. 3,794,992, issued Feb. 26, 1974 to Gehman discloses an intrusion detection system in which a central VHF transmitting antenna is coupled to buried sensing antennas which surround the perimeter. Gehman teaches a series of separate identical sensing antennas consisting of a single insulated wire of size between number 10 to number 30.

One of the limiting factors in the use of either the pulse or CW leaky coaxial cable sensor is the effect of a changing environment. For example, changing soil moisture content for a buried leaky cable sensor can have a detrimental effect, as the permitivity and conductivity of the soil also changes, therefore causing the return signal to alter in magnitude and phase. In practice, these effects have been separated from legitimate targets by means of high pass filtering. The success of this operation depends on the speed of the environmental effects relative to the lowest speed target. While this has been successful for many applications, the environmental effects are still the major source of nuisance alarms.

In a leaky coaxial cable sensor employing a transmit cable and a receive cable there is a change in the relative phase of the received signal as a target walks along the transducer cables. This can be demonstrated by plotting the incremental in-phase signal as a function of the incremental quadrature signal as the target walks along the transducer. The resulting plot is circular and the distance the target moves to complete 360° of relative phase is equivalent to half a wavelength at the cable velocity of propagation. It should be noted that since the velocity of propagation inside the cable is typically 79% that of free space then the wavelength is also reduced by 79%.

If all targets walked parallel to the transducer cables and within the detection zone, detection could be based on target induced change in relative phase and be much more immune to environmental effects as several cycles of phase rotation take place prior to detection. While rapid environmental changes cause some phase change they do not normally produce the same amount of phase change as a human target. In the system of this invention the detection circuit effectively tracks the target, and in doing so it uses more target information to reduce nuisance alarms due to the environment.

SUMMARY OF THE INVENTION

The present invention utilizes a separate transducer element, typically an antenna at the center of the area as taught in U.S. Pat. No. 3,794,992 since this produces appropriate wavefronts which provide a relative phase change in the received signal for targets crossing the transducer cables at right angles as would a typical intruder. This is in contrast to the type of sensor in Canadian Pat. No. 1,014,245 which provides very limited phase changes for targets crossing the transducer cables at right angles.

Specifically, the invention relates to an intrusion detection system comprising an antenna located within the perimeter of an area to be protected. A leaky transmission line extends around the perimeter so that the presence of an intruder alters the electromagnetic coupling between the antenna and transmission line. An RF transmitter is coupled to one of the antenna and transmission line and a receiver coupled to the other. Means are provided for detecting incremental changes in the in-phase and quadrature components of signals received at the receiver and circuit means accumulate the incremental changes to indicate the presence of an intruder.

This system results in significantly improved performance in terms of probability of target detection and low false alarm rate.

BRIEF DESCRIPTION OF THE DRAWINGS

The present invention will be more fully understood from the following description of preferred embodiments taken in conjunction with the accompanying drawings in which.

DESCRIPTION OF THE PREFERRED EMBODIMENTS

Figure 1B:
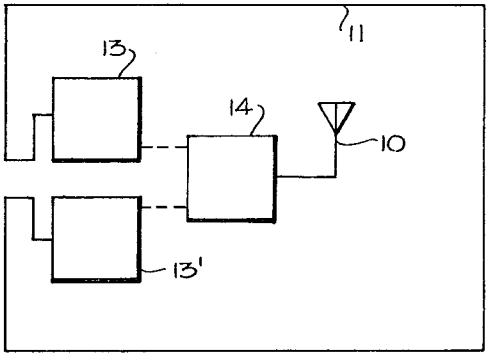
FIGS. 1*a*, 1*b*, 1*c*, 1*d*, 1*e*, 1*f* and 1*g* are diagrams of intrusion detection systems using a central antenna.
Figure 1D:
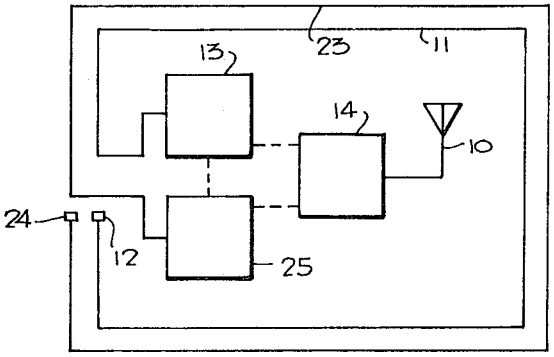
Figure 1A:
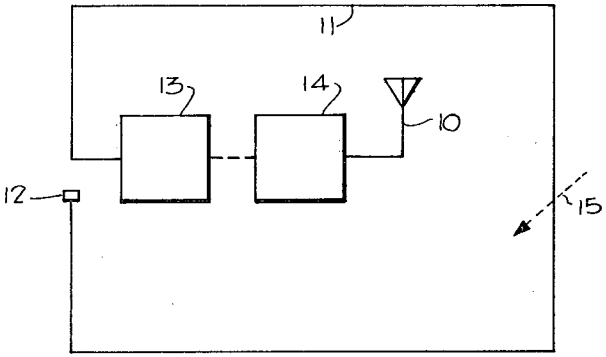

FIG. 1*a* indicates schematically an intrusion detection system of the type using an antenna 10 located centrally in the area to be protected with a leaky coaxial cable 11 extending around the perimeter of the area. The antenna transmits an RF signal from transmitter 14. The coaxial cable is terminated at one end in a matching load 12 and has a receiver 13 coupled to the other end. By reciprocity, the cable may be used as the transmitting element and the antenna as the receiving element. The dotted line between transmitter 14 and receiver 13 indicates that the receiver employs synchronous detection using a reference signal obtained from the transmitter.

The presence of an intruder alters the coupling between the antenna and the cable producing a change in the signal at receiver 13 which may be used to indicate the presence of such an intruder. Variations in the amplitude of the received signal do provide an indication that intrusion has occurred; however such variations can also be the result of changes in the environment. While it is known to separate out environmental effects by use of high pass filters, applicant has determined that much greater sensitivity coupled with a lower false alarm rate can be obtained by the subsequent detection and tracking of changing magnitude and phase components in the received signal, indicative of a moving intruder.

Figure 2B:
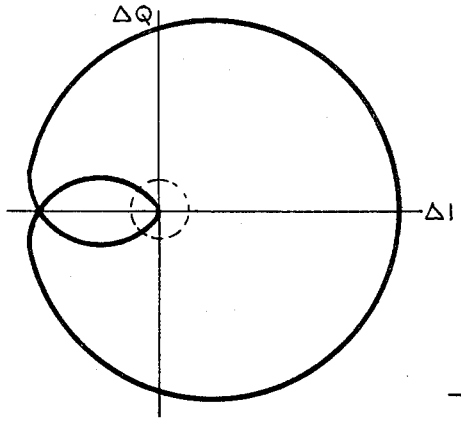
FIG. 2*a* is a graph of incremental phase variations of an idealized response to a target crossing at right angles to a cable-cable system and FIG. 2*b* is an idealized response to a target crossing a cable at right angles in an antenna-cable system.
Figure 2A:
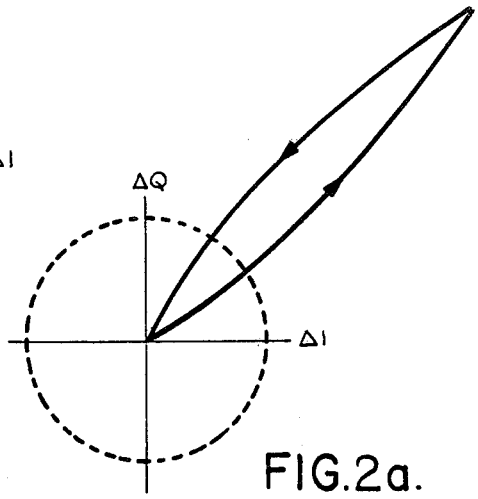

As taught in the Harman U.S. Pat. No. 4,091,367, issued May 23, 1978, the in-phase I and out-of-phase Q components from receiver 13 are processed to provide incremental components ΔIn and ΔQn. This results in removing any slowly changing components of the profile of the system as might be caused by environmental changes. The incremental components ΔIn and ΔQn are representative of a target response. A system using a pair of parallel cables, as in U.S. Pat. No. 4,091,367, will provide a locus of ΔI,ΔQ variations in response to a target crossing the cables as shown in FIG. 2*a*. A system using a central antenna, as shown in FIG. 1*a*, will provide a locus of ΔI,ΔQ variations in response to a target crossing the single cable at right angles, as shown in FIG. 2*b*.

The prior art system response, as shown in FIG. 2*a*, involves essentially a measurement of the magnitude of a vector in the ΔI,ΔQ plane. If the vector exceeds a certain magnitude threshold, for example the dotted circle in FIG. 2*a*, then a decision can be made that a target has been detected. In contrast, in the response of FIG. 2*b*, applicants use as a criterion for detection, the angular displacement and magnitude swept out in the ΔI,ΔQ plane which is a much more sensitive measurement leading to improved rejection of alarms arising due to rapid changes in environment. Hereinafter the term "phase" will be used for angular displacement in the ΔI,ΔQ plane. The small dotted circle centered about the origin in FIG. 2*b* represents a tracking threshold designed to reject perturbations associated with received noise. Any signal level, however caused, falling below this tracking threshold is ignored and magnitude and phase computations are not performed. Thus, a dead zone for input signals is established.

It has been found that effective discrimination against environmentally induced variations in ΔI and ΔQ can be obtained by performing phase tracking. Phase is indicated by a rotation of a target vector in the ΔI,ΔQ plane. It may be tracked by continually accumulating the phase swept out as an intruder crosses the system or it may be measured incrementally in a sector-like fashion whenever the target induced phase crosses a sector boundary defined in the ΔI,ΔQ plane.

It has also been found that magnitude tracking provides effective discrimination between responses from targets of different size. Magnitude may be indicated by a number of different methods. One method is to determine the peak amplitude during an intrusion. If both peak amplitude and accumulated phase exceed predetermined thresholds, an alarm is declared. A second method consists of accumulating the area within the target response generated in the ΔI,ΔQ plane. This can be accomplished either by linearly computing total area swept out as an intruder proceeds through the system or by the incremental computation of area based on crossings of sector boundaries in the ΔI,ΔQ plane. Upon a target crossing into a new sector an estimate of the area accumulated in the previous sector is made. When both accumulated area and phase exceed specific thresholds an alarm situation is indicated.

A third method for tracking magnitude is to accumulate the arc length swept out in the ΔI,ΔQ plane by a target. Arc length is directly proportional to the product of the amplitude of the target induced response vector and the phase swept out by this vector. Incremental arc lengths can be accumulated or computation can be made based on the crossings of sector boundaries in the ΔI,ΔQ plane. Upon crossing into a new sector an estimate of the arc length accumulated in the previous sector is stored. When both accumulated arc length and phase exceed specific thresholds an alarm is declared.

Having thus briefly set out alternative criteria which may be used in target detection the following preferred embodiments are described in terms of accumulation of incremental changes in phase and area. It will be born in mind, however, that the other techniques are as applicable.

The particular single cable system of FIG. 1*a* has a disadvantage that a phase change is not generated for intruders crossing along a path which makes an angle of about 45° with the cable in a direction away from the receiver but towards the antenna, shown by arrow 15 in FIG. 1*a*. This can be shown by considering the general expression for phase variation in a typical system as follows:

$$\frac{d\phi}{dt} = -2\pi f\left[\frac{1}{c}\,\frac{dR_T}{dt} + \frac{1}{v}\,\frac{dL_T}{dt}\right]$$

Where:

$\phi$—relative phase of target induced returned signal with respect to transmit signal $R_T$—minimum distance from antenna to target $L_T$—distance along cable from receiver to target v—propagation velocity of signal in cable f—frequency of transmitted signal t—time c—velocity of propagtion of light x—horizontal distance from target to cable R—perpendicular distance from cable to antenna Assumed —R>>x The null phase response occurs where $$\frac{1}{c}\,\frac{dR_T}{dt} = -\frac{1}{v}\,\frac{dL_T}{dt}.$$

It will be noted that for a velocity of propagation in the cable that is typically 79% that of free space this occurs at an angle of 36°. Correspondingly, a doubled phase response occurs for targets crossing along a path at right angles to arrow 15.

This disadvantage can be overcome by the system of FIG. 1*b* which adds a second receiver 13' at the opposite end of the cable. The condition of null phase response for one of the receivers corresponds to a condition of enhancedresponse for the other. This system can ing from $\Delta I_{i-1}$, $\Delta Q_{i-1}$ to $\Delta I_i, \Delta Q_i$. The phase angle $\phi$ of the same target response is given by $\phi = \mathrm{Tan}(-1\Delta Q/\Delta I)$. The increment in this phase angle, $\Delta\phi$ may be conveniently obtained by defining a function $B_i$:

$$B_i = \Delta I_i \Delta I_{i-1} + \Delta Q_i \Delta Q_{i-1}$$

whereupon it can be shown that $\Delta\phi = \tan(-1^{B_i}/A_i)$.

Sampling under the control of clock pulse line 49 the $\Delta I$ and $\Delta Q$ components are supplied to latch circuits 70, 71, 72 and 73. This provides sample components which are adjacent in time sequence such as $\Delta I_n$ and $\Delta I_{n-1}$, $\Delta Q_n$ and $\Delta Q_{n-1}$. Multipliers 77 and 75 together with adder 76 then supply the $B_i$ component and multipliers 74 and 78 in conjunction with subtractor 79 supply the $A_i$ component. The angle increment is supplied from arctan circuit 80 on line 81 and the area increment supplied on line 82.

To ensure that only signals above a certain tracking threshold are processed switches 83 and 84 are provided inthe output lines controlled by actuator 85. $\Delta I_i$ and $\Delta Q_i$ signals are fed to a circuit 86 which provides the magnitude function $M_i = \sqrt{(\Delta I_i)^2 + (\Delta Q_i)^2}$; alternately, an approximation such as $M_i - \max(|\Delta I_i|, |\Delta Q_i|) + \frac{1}{2}\min(|\Delta I_i|, |\Delta Q_i|)$ may be used. The signal representative of $M_i$ is supplied to a comparator circuit 87 having the selected value of tracking threshold supplied to terminal 88. Thus, when signal values are such that the magnitude does not exceed the threshold value the area and phase increment lines connected to the circuit of FIG. 7 are set to zero.

Figure 3:
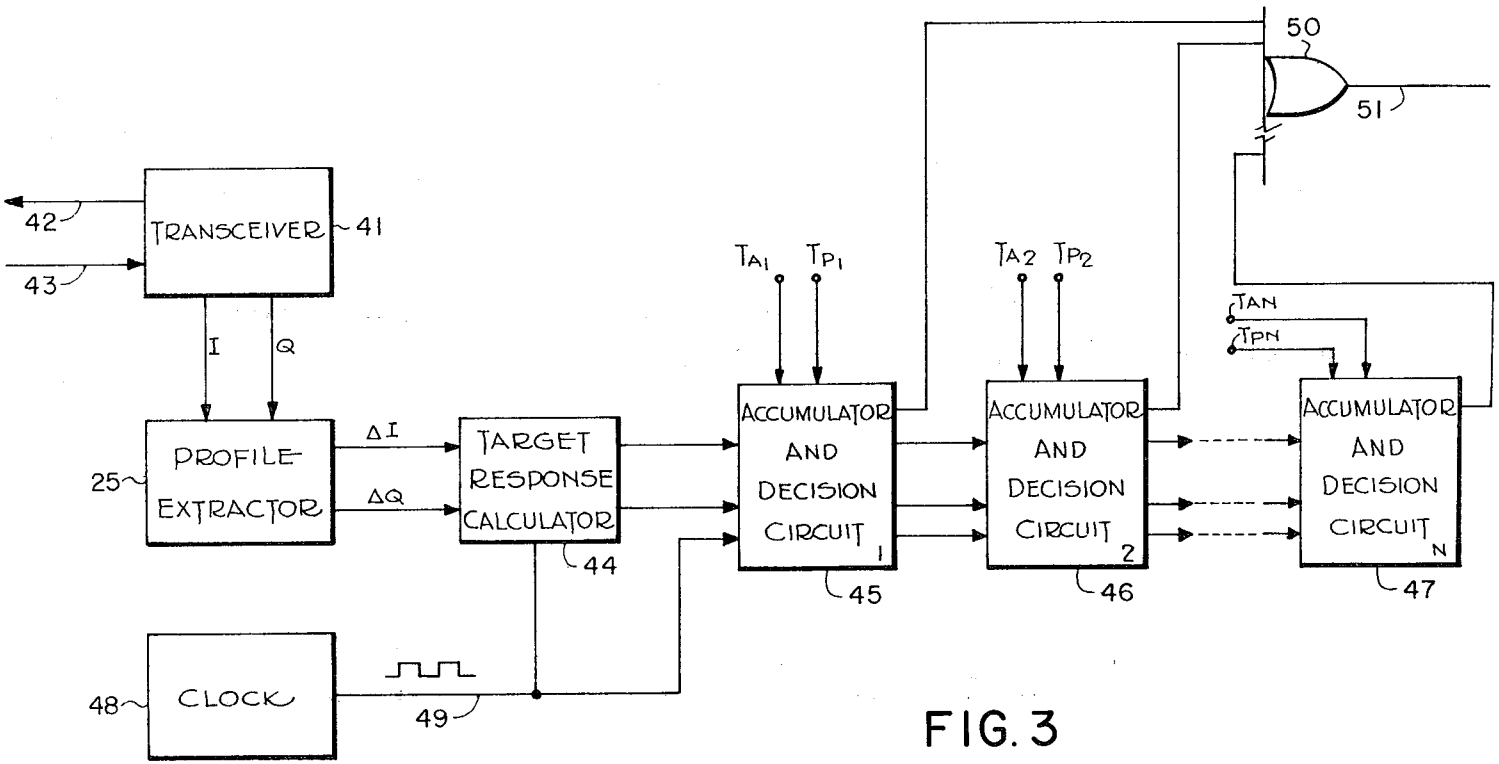
FIG. 3 is a schematic diagram of the signal processing circuitry for a single cable-antenna system.
Figure 7:
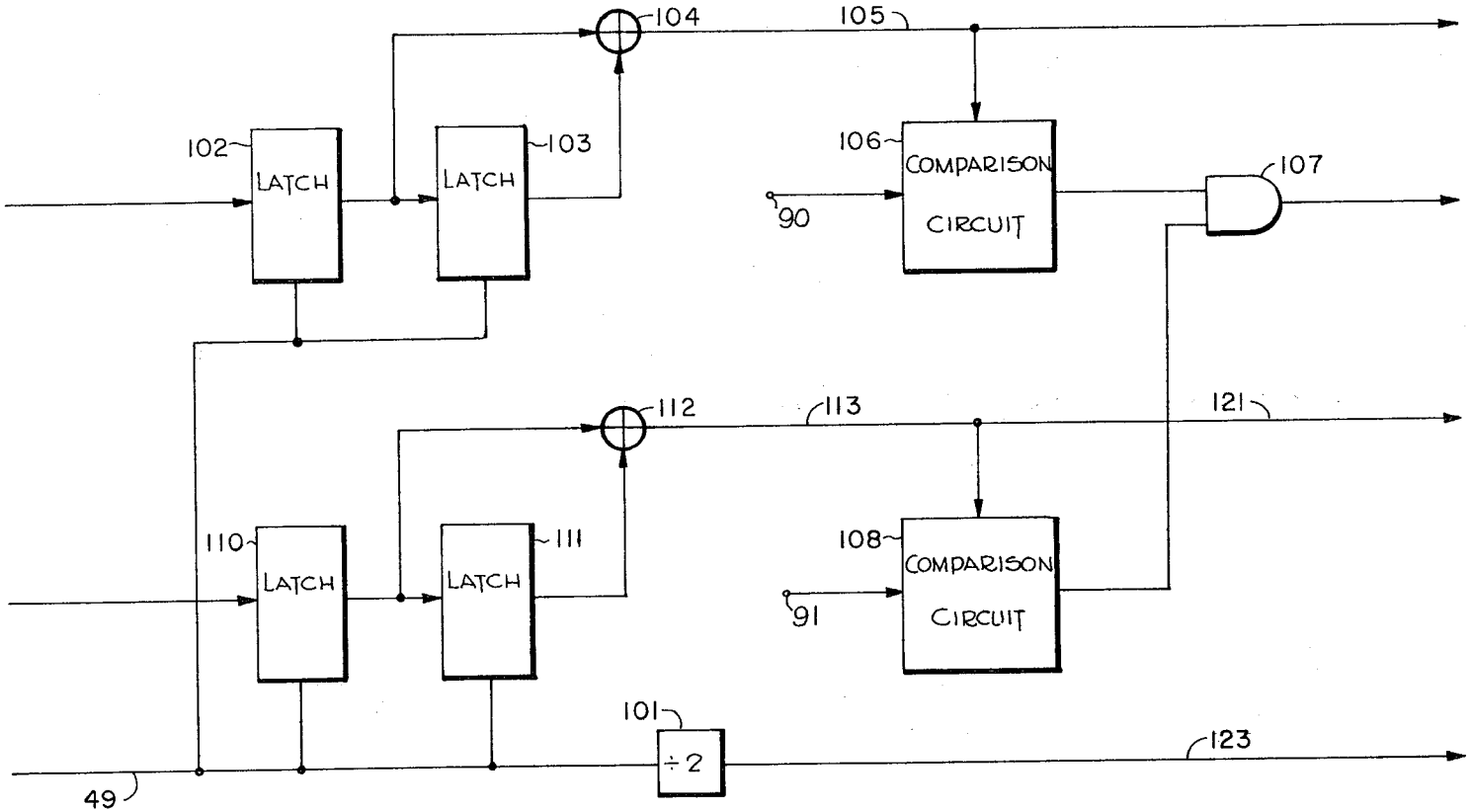
FIG. 7 is a schematic diagram of one of the accumulator and decision circuits of the system of FIG. 3.

FIG. 7 is a schematic diagram of one of the accumulator stages such as stage 45 shown in FIG. 3. Clock pulses are again supplied on line 49 and reduced by a factor of two in bistable 101 for each successive accumulator stage. The effect is to increase the integration time of each successive accumulator by a factor of two. Latch circuits 102 and 103 provide incremental area components in time sequence to circuit 104 which gives a signal representing the accumulated incremental area on lead 105. Similarly, latch circuits 110 and 111 provide adjacent phase components to adder circuit 112 giving a signal representing the accumulated incremental phase on line 113. If at any time the increment of area accumulated in circuit 106 exceeds an area detection threshold supplied at terminal 90 and the phase change exceeds a phase detection threshold supplied at terminal 91 then an alarm is given via AND gate 107. Signal lines 105, 121 and 123 carry forward the accumulated incremental phase and area quantities and clock signal to the next accumulator circuit 46.

Figure 8:
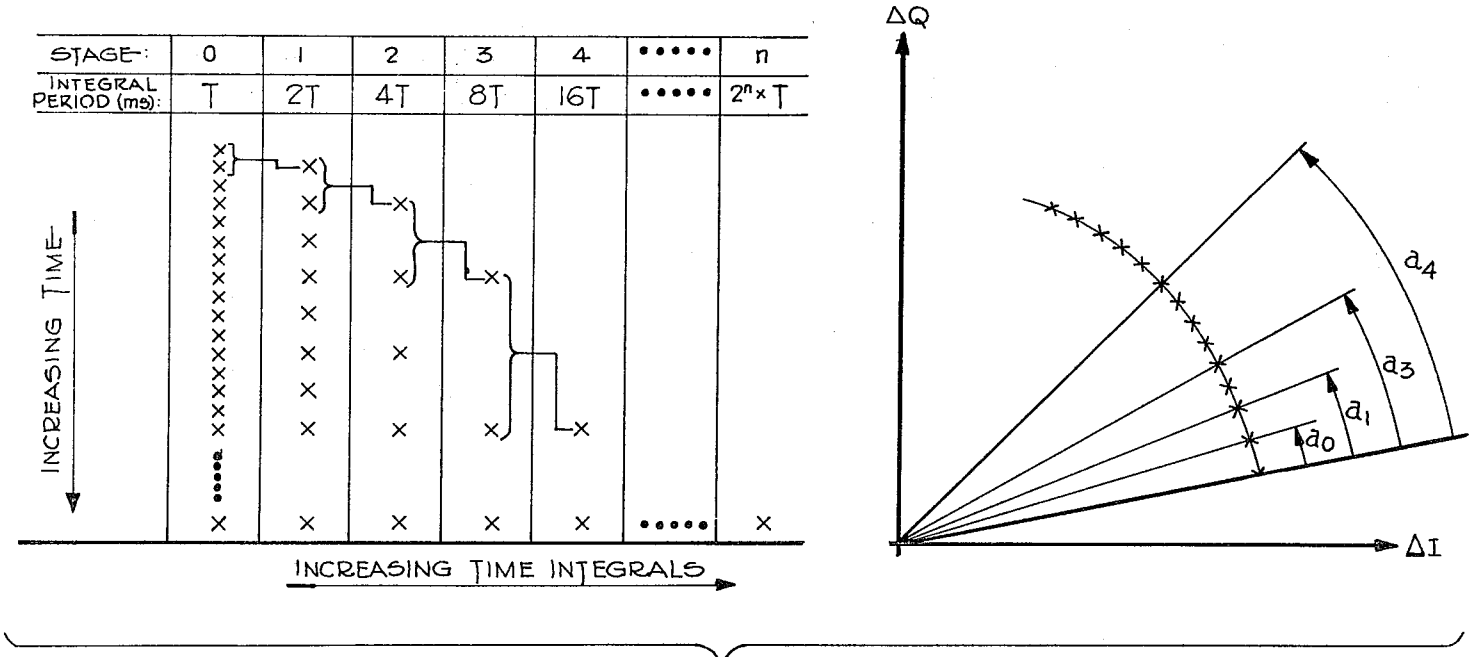
FIG. 8 is a diagram and table relating to the operation of the accumulator and decision circuit.

The operation of the decision circuits 45, 46, 47 will be clearer from an inspection of the $\Delta I, \Delta Q$ plane diagram and related table shown in FIG. 8. It will be noted that successive accumulator stages accumulate, or integrate, the signals over longer periods of time. Thus, a strong response from a target moving quickly relative to the sampling period will trigger one of the first accumulator circuits such as circuit 45. The same target moving more slowly will require greater time to generate the same amount of accumulated angle and area and thus, only trigger a circuit later in the sequence such as circuit 47. The system permits the setting of different threshold values to meet site-dependent target and environmental conditions. For example, the threshold levels of the earlier circuits may be set correspondingly lower to provide enhanced detection of high speed targets since environmental effects are generally slowly changing.

Figure 1C:
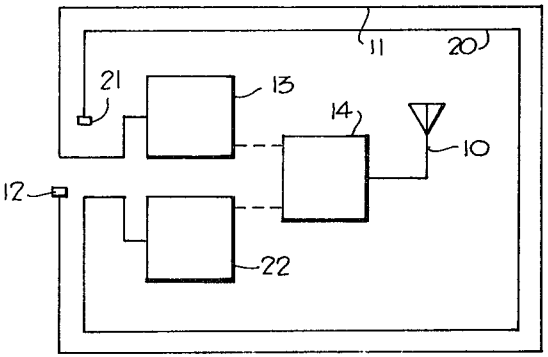
Figure 9:
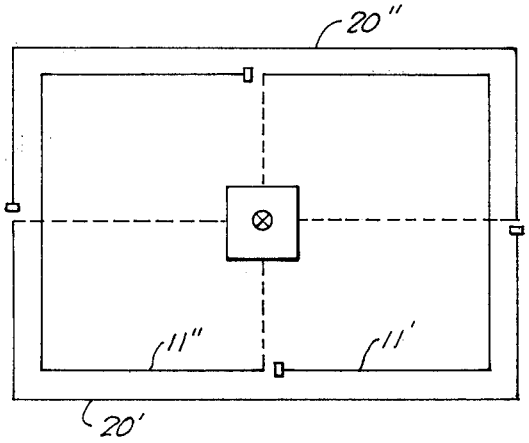
FIG. 9 is a diagram of an intrusion detection system with target location capability to one of four quadrants.

Thus, the system for detecting targets in a single cable-antenna system has been described. Clearly, when more than one cable is used, a corresponding receiving and signal processing system is provided for each cable. Various changes in the system which are still within the inventive concept will be clear to those skilled in the art. For example, the basic system indicates that a target has crossed the perimeter but not the location of the crossing. The basic configuration, as shown in FIG. 1*c* might be modified to use cables split into two sections 11' and 11'', 20' and 20'', and arranged so that each of the cables terminated in a different quadrant. Such an arrangement is shown in FIG. 9. This system could then be used to give a rough indication (as to the nearest quadrant) as to where intrusion occurred. Alternatively two slightly differing frequencies can be transmitted in the systems of FIG. 1*d* and the angular displacement between the target induced responses gives the fraction of total perimeter length at which the crossing has occurred. Since the disclosed system already calculates phase angles it can readily be adapted to use this target location technique.

We claim:

1. An intrusion detection system comprising an antenna located within the perimeter of an area to be protectd, a leaky transmission line extending around the perimeter so that the presence of an intruder alters the electromagnetic coupling between the antenna and transmission line, an RF transmitter coupled to one of the antenna and transmission line and a receiver coupled to the other, means detecting incremental changes in the in-phase and quadrature components of signals received at said receiver and means separately measuring and accumulating magnitude and phase angle of said incremental changes to track and indicate the presence of an intruder.

2. A system as set out in claim 1 wherein said incremental in-phase component is $\Delta I$ and said incremental quadrature component is $\Delta Q$ and said accumulating means produces signals indicative of the phase angle and area swept out by these components in the $\Delta I, \Delta Q$ plane.

3. A system as set out in claim 2 wherein the presence of an intruder is indicated when both the plane angle and area swept in the $\Delta I, \Delta Q$ exceed present amounts.

4. A system as set out in claim 2 wherein said means separately measuring and accumulating includes circuitry to calculate the functions:

$$A_i = \Delta I_i \, \Delta Q_{i-1} - \Delta Q_i \, \Delta I_{i-1}$$

$$B_i = \Delta I_i \, \Delta I_{i-1} + \Delta Q_i \, \Delta Q_{i-1}$$

and further includes accumulating circuits responsive to $A_i$, representing the magnitude of swept area, and responsive to arctan $B_i/A_i$, representing angular change, to indicate when accumulate values of area magnitude and angular change exceed predetermined amounts.

5. A system as set out in claim 4 further including a circuit responsive to $M = \sqrt{\Delta I^2 + \Delta Q^2}$ to inhibit said means separately measuring and accumulating when M is less than a threshold value.

6. A system as set out in claim 5 wherein a series of measuring and accumulating circuits are provided controlled by a source of clock pulses and means setting be used only where the perimeter is short enough that cable grading is not required.

A different arrangement to overcome this disadvantage is shown in FIG. 1*c* by the addition of an adjacent second cable 20, parallel to cable 11, an associated load 21 and receiver 22. Propagation along the cable 20, however, is in the opposite direction due to the arrangement of load 21 and receiver 22. Tha cables are so spaced that when no phase change is experienced by one of the cables, for a crossing at approximately 45° to the cable in a direction away from the receiver but towards the transmitter, such a condition cannot exist in the other cable at that location, and the other cable exhibits an enhanced phase response.

Yet a further arrangement using two cables is shown in FIG. 1*d*. This builds on the system of FIG. 1*a* by adding a second cable 23 with a load 24 and transceiver 25, with propagation along cables 11 and 23 being in the same direction. The condition when no phase shift occurs for both cables is met by also using the pair of cables as a detection system of the type shown in U.S. Pat. No. 4,091,367, at a different frequency from that transmitted from antenna 10. That is, energy is transmitted by transceiver 25 in the transmit mode from one of the cables and received at the other. This second system also uses tracking of changes in magnitude and phase components to provide detection of targets crossing at 45°. The reciprocity of the system permits an alternative arrangement such as that shown in FIG. 1*f* in which 13' and 25' are transmitters and 14' a receiver. As a further alternative, a single frequency could be used with transceiver 25 in a transmit mode, so that one of the cables serves as a transmitting element and the other cable and the antenna serve as receiving elements; that is, 13' could be a transmitter and 14' and 25 receivers, as illustrated in FIG. 1*g*.

While FIG. 1*c* could also be used in this fashion, by superposing a detection system of known type using only the two coaxial cables, a practical difficulty arises. It is common to use graded cables; that is, cables in which the size of the apertures in the cable shield increases with linear distance from the receiver to compensate for the attenuation of the cable. This leads to improved sensitivity. Thus, cable 11 in FIG. 1*a* will usually be graded. The cable in FIG. 1*b* will not be graded and the grading of the cables in FIG. 1*c* will be in opposite directions thereby making it impracticable to use them also as a known two-cables detecting system. The cables of FIG. 1*d* can be graded and still be used as a two-cable detecting system.

Figure 1E:
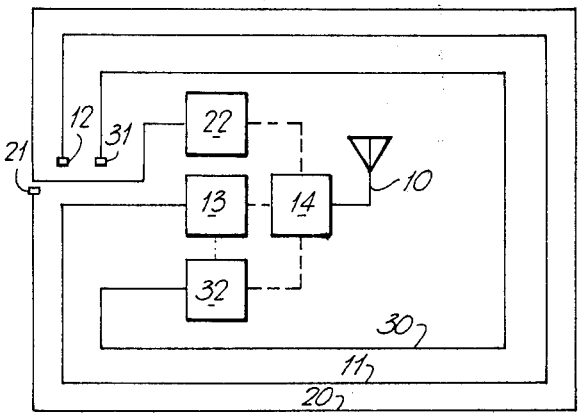
Figure 1F:
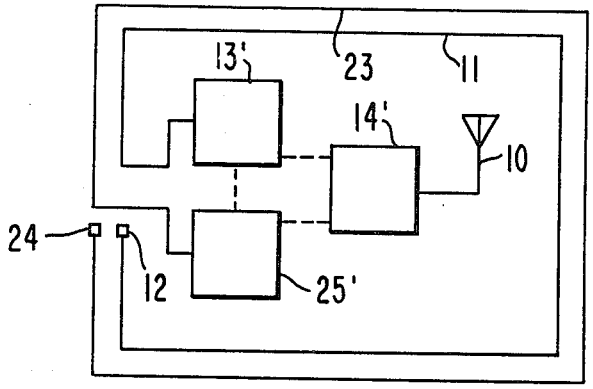
Figure 1G:
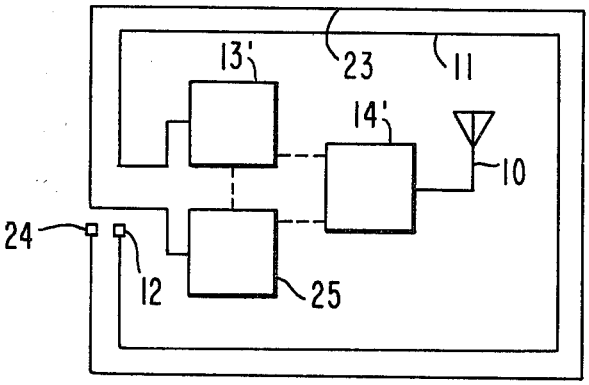

Yet a further development of the system is shown schematically in FIG. 1*e*. This includes a system as shown in FIG. 1*c* with cables 11 and 20 graded in opposite directions. A third cable 30 graded in the same direction as cable 11 is added to permit the implementation of a two-cable complementary sensing scheme. Load 31 and transmitter-receiver 32 are connected to cable 30. With these three cables, there are the following four sensor combinations:

| | |
|---|---|
| 11, 30 is a normal leaky cable sensor mode (one transmit, one receive) | |
| 11 and antenna 10 | for phase shift detection |
| 20 and antenna 10 | |
| 30 and antenna 10 | |

System performance is thus improved by the combination of different sensing modes.

The cables each function as part of a single cable-antenna sensor. Since there is only one buried cable as opposed to the two-cable sensor, environmental effects are reduced. In addition a single cable-antenna sensor system provides increased height response when compared to a two-cable sensor.

The two cables 11 and 30 combined in the cable-cable sensor mode, spaced about five feet apart can be used to establish an additional detection zone. This independent sensing mode complements the single cable-antenna system.

FIG. 3 is a block diagram of the signal processing circuits used in a single antenna-cable configuration. Similar circuits are used for the other arrangmements described. The individual circuits are further described in FIGS. 4–7. Referring first to FIG. 3, transceiver 41 provides the appropriate output signal on line 42 for transmission from the single antenna and receives the signal back from the cable on line 43. Appropriate I and Q components are generated and supplied to circuit 25 which functions to extract the profile producing the output incremental quantities ΔI,ΔQ. These quantities are passed to a computation circuit 44 which calculates the increment in area and in phase angle of the potential target response in the ΔI,ΔQ plane. The incremental area signal and the incremental phase signal are then accumulated separately in a succession of stages three of which are shown at 45, 46 and 47 under control of clock signals from clock generator 48. If the accumulated area and accumulated phase signal in any stage exceed predetermined detection thresholds then an alarm signal is generated and passed through OR gate 50 to an alarm line 51.

The detection thresholds, $T_{A1}$, $T_{P1}$, etc., supplied to the decision circuits are set to different predetermined values to provide detection selectivity. As will be shown below, each decision circuit has an accumulating time double that of the preceding circuit. This greater integration time is needed for the detection of slower moving targets and also reduces the effect of random components in the received signals.

Figure 4:
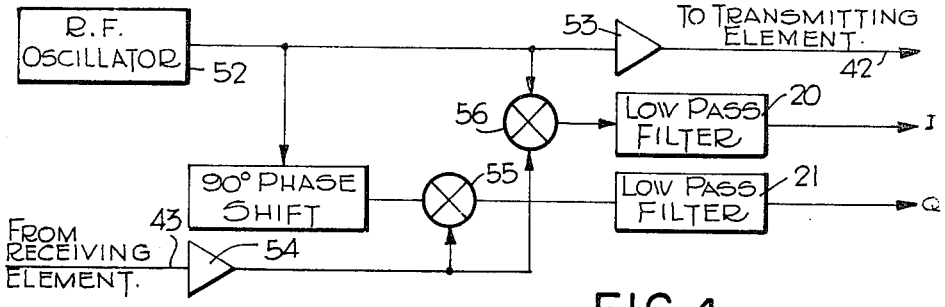
FIG. 4 is a schematic diagram of the transceiver used in the system of FIG. 3.

FIG. 4 shows the transceiver in greater detail. An RF oscillator 52 supplies the output line 42 through an amplifier 53. The signal received on line 43 is passed to an amplifier 54 and synchronously demodulated by mixers 55 and 56 and the I and Q signals passed through low pass filters 20 and 21 to band limit the signal and to improve noise performance.

Figure 5:
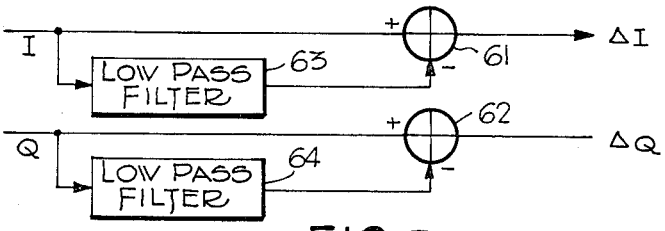
FIG. 5 is a schematic diagram of the circuit which extracts the profile of the signal in the circuit of FIG. 4.

FIG. 5 shows the profile remover 25, consisting of summing circuits 61 and 62 in conjunction with low pass filters 53 and 64 which produces the incremental values ΔI,ΔQ. This arrangement acts as a high pass filter.

Figure 6:
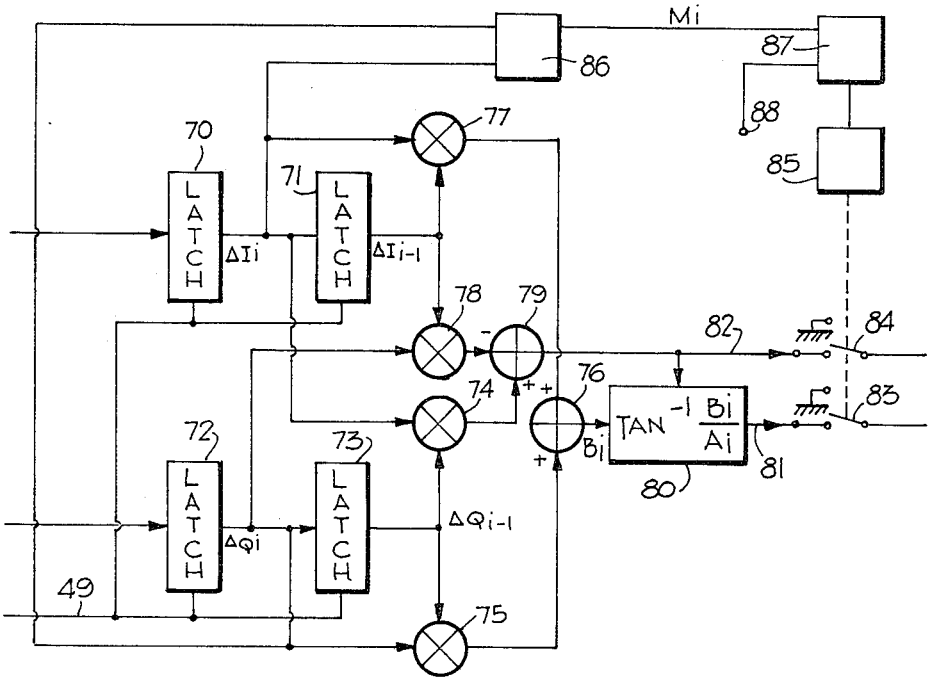
FIG. 6 is a schematic diagram of the circuit which calculates the magnitude, incremental area and angle in the $\Delta I, \Delta Q$ plane as the response is generated.

FIG. 6 shows details of circuit 44 which calculates the incremental values of area and phase in the ΔI,ΔQ plane. The object is to obtain a measure both of the area swept out by the target response following a curve such as FIG. 2*b* and the angular displacement through which the target response moves. This is done as a response is sampled by generating an area function $A_i$, corresponding to sample i, defined by:

$$A_i = \Delta I_i \Delta Q_{i-1} - \Delta Q_i I_{i-1}$$

It can be shown that $A_i$ is equal to twice the area swept out by a target response in the ΔI,ΔQ plane movseparate phase angle and area thresholds for each circuit.

7. A system as set out in claim 6 wherein each measuring and accumulation circuit except the first has an integration time double that of its preceding circuit.

8. A system as set out in claim 4 further including a circuit responsive to the approximation $M=\max(|\Delta I|, |\Delta Q|)+\frac{1}{2}\min(|\Delta I|, |\Delta Q|)$ to inhibit said means separately measuring and accumulating when M is less than a threshold valve.

9. A system as set out in claim 1 wherein the transmission line is leaky coaxial cable.

10. A system as set out in claim 9 wherein the leaky coaxial cable has a matching termination at one end and the receiver at the other.

11. A system as set out in claim 9 wherein the leaky coaxial cable has a receiver at each end.

12. A system as set out in claim 9 further including a second transmission line adjacent the first-mentioned transmission line, a receiver connected to each transmission line whereby the received signals induced by the antenna in the transmission lines travel in opposite directions.

13. A system as set out in claim 12 wherein the first-mentioned transmission line and said second transmission line are graded leaky coaxial cables.

14. A system as set out in claim 13 and further including a third leaky cable with a transceiver connected thereto and graded in a corresponding fashion to one of the other cables to permit electromagnetic coupling thereto and to the antenna.

15. A system as set out in claim 9 further including a second transmission line adjacent the first-mentioned transmission line, transmitters operating at different frequencies coupled to each transmission line and corresponding receivers coupled to the antenna.

16. A system as set out in claim 9 further including a second transmission line adjacent the first-mentioned transmission line, a transmitter coupled to one of the transmission lines and receivers coupled to the antenna and to the other transmission line.

17. An intrusion detection system for a site where an intruder is constrained to follow a fixed path, comprising a pair of leaky transmission lines along said path, an RF transmitter coupled to one of the lines and a receiver to the other means detecting incremental changes in the in-phase and quadrature components of signals received at said receiver and providing $\Delta I$ and $\Delta Q$ signals representing said incremental changes, means producing signals indicative of the area and phase angle swept out by these components in the $\Delta I, \Delta Q$ plane and means indicating the presence of an intruder when both area and phase angle exceed preset amounts.

* * * * *